US009326581B1

(12) United States Patent
Lowery

(10) Patent No.: US 9,326,581 B1
(45) Date of Patent: May 3, 2016

(54) NAIL ABRADING IMPLEMENT

(71) Applicant: Robert S. Lowery, Conway, SC (US)

(72) Inventor: Robert S. Lowery, Conway, SC (US)

( * ) Notice: Subject to any disclaimer, the term of this patent is extended or adjusted under 35 U.S.C. 154(b) by 0 days.

(21) Appl. No.: 14/803,106

(22) Filed: Jul. 19, 2015

(51) Int. Cl.
*A45D 29/18* (2006.01)
*A45D 29/04* (2006.01)

(52) U.S. Cl.
CPC ..... *A45D 29/04* (2013.01); *A45D 2029/045* (2013.01)

(58) Field of Classification Search
CPC ..... A45D 29/00; A45D 29/04; A45D 29/06; A45D 29/11; A45D 29/12; A45D 29/17
See application file for complete search history.

(56) References Cited

U.S. PATENT DOCUMENTS

| | | | | |
|---|---|---|---|---|
| 838,440 | A | 12/1906 | Neff | |
| 848,337 | A | 3/1907 | Bailer | |
| 848,345 | A | 3/1907 | Bussell | |
| 2,388,292 | A | 11/1945 | Sapyak | |
| 5,119,839 | A | 6/1992 | Rudolph | |
| 7,918,233 | B2 | 4/2011 | Burgess | |
| 2008/0264438 | A1 | 10/2008 | Clelland | |
| 2009/0145451 | A1* | 6/2009 | Burgess | A45D 29/04 132/75.6 |
| 2015/0128365 | A1* | 5/2015 | Kalish | A45D 29/17 15/104.94 |
| 2015/0208784 | A1* | 7/2015 | Choe | A45D 29/12 132/76.4 |

* cited by examiner

*Primary Examiner* — Rachel Steitz
(74) *Attorney, Agent, or Firm* — QuickPatents, LLC; Kevin Prince

(57) ABSTRACT

An implement for abrading or filing a nail of a person, such as a fingernail or a toenail, includes a body that has a first side, a second side, and a peripheral edge. The peripheral edge has a peripheral groove formed therearound that has a floor that continuously varies in depth based on a radial position. A perimeter abrading surface is applied to the floor of the groove. A first abrading surface is applied to the first side of the body, preferably via a removable disk that adheres with an adhesive to the first side of the body. A second abrading surface, preferably via a second removable disk that adheres with the adhesive to the second side of the body, is preferably applied to the second side of the body, the second abrading surface having a different abrasiveness or grit than the first abrading surface.

18 Claims, 3 Drawing Sheets

NAIL ABRADING IMPLEMENT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to personal care, and more particularly to a nail file.

DISCUSSION OF RELATED ART

Nail care and grooming represents a large market, and as such there have been a many prior art devices design to aid in the grooming and maintenance of both fingernails and toe nails. The standard nail file comprises a flat, elongated base having an abrading surface applied to each side. While such a device is useful for abrading and polishing nails, one drawback of such a device is that there is no guide for ensuring the proper amount of abrading off of the end of the nail. One side of the nail, for example, may be easily abraded further than desired and further than the other side, resulting in an uneven look. Such a device requires forethought and skill to obtain an evenly filed nail. Further, if the abrading surface of one side of such a device becomes more worn than the other side, there is no provision for interchangeably applying a new abrading surface to the side that's worn. Moreover, such a product is inconvenient to carry in a pocket, for example, since it is elongated and abrasive, and potentially injurious to a person's hand who is not careful about inserting his hand into his pocket too quickly. Further, such a device, being flat, is limited to two abrasive sides and therefore, at the most, two different materials with different abrasiveness or grit.

One prior art device, disclosed in U.S. Pat. No. 5,119,839 to Rudolph on Jun. 9, 1992, teaches a single-sided file having a removable abrasive surface, and a perimeter groove having a polishing surface for polishing the edges of a nail. Such a device, however, is still limited to at most two materials having differing abrasiveness, and such a device is also elongated like the standard nail file, making it somewhat cumbersome to carry in one's pocket. Further, such a device has a relatively small handle that is difficult to firmly grasp and maintain in a desired angular orientation.

Another nail file device, taught in U.S. Pat. No. 7,918,233 to Burgess et al. on Apr. 5, 2011, includes a flat, triangular-shaped nail grooming apparatus that includes a perimeter groove having an abrading surface therein, along with a central aperture having a plurality of inwardly-directed bristles for scrubbing the outer surface of a person's finger. This type of device, however, does not include additional abrading surfaces, and the abrading surface thereof is not replaceable once worn. Further, such a device provides an abrading channel having a uniform depth, and as such the length of the nail filed therewith is fixed and not selectable by the user.

Therefore, there is a need for a device that includes more than two different abrading surfaces, at least two of which are interchangeable and replaceable once worn. Such a needed device would include a perimeter groove with an abrading surface that varies in depth based on radial location, making the length of the nail selectable by the user. Such a needed device would be easy to carry in one's pocket or purse without potentially causing injury, and would be readily gripped by one hand while filing nails on the other hand, for example. The present invention accomplishes these objectives.

SUMMARY OF THE INVENTION

The present device is an implement for abrading or filing a nail of a person, such as a fingernail or a toenail. A body has a first side, a second side, and a peripheral edge. The peripheral edge has a peripheral groove formed therearound. The groove has a floor that continuously or smoothly varies in depth based on a radial position. A perimeter abrading surface is applied to the floor of the groove.

In use, the person abrades a nail by inserting the nail into the groove at the desired radial location and, moving the implement back and forth, the nail is abraded to a length associated with the radial position.

A first abrading surface is applied to the first side of the body, preferably via a removable disk that adheres with an adhesive to the first side of the body. The person may abrade a top or edge portion of the nail by moving the nail back and forth relative to the implement across the first abrading surface. A second abrading surface, preferably via a second removable disk that adheres with the adhesive to the second side of the body, is preferably applied to the second side of the body, the second abrading surface having a different abrasiveness or grit than the first abrading surface. Both the first side and second side of the body may include a first recessed area, and a second recessed area, for receiving the first and second removable disks, respectively.

The present invention is a device that includes more than two different abrading surfaces, at least two of which are interchangeable and replaceable once worn down. The present implement includes a perimeter groove with an abrading surface that varies in depth based on radial location, making the length of the nail selectable by the user. The invention is easy to carry in one's pocket or purse without causing injury, and is readily gripped by one hand while filing nails on the other hand, for example. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
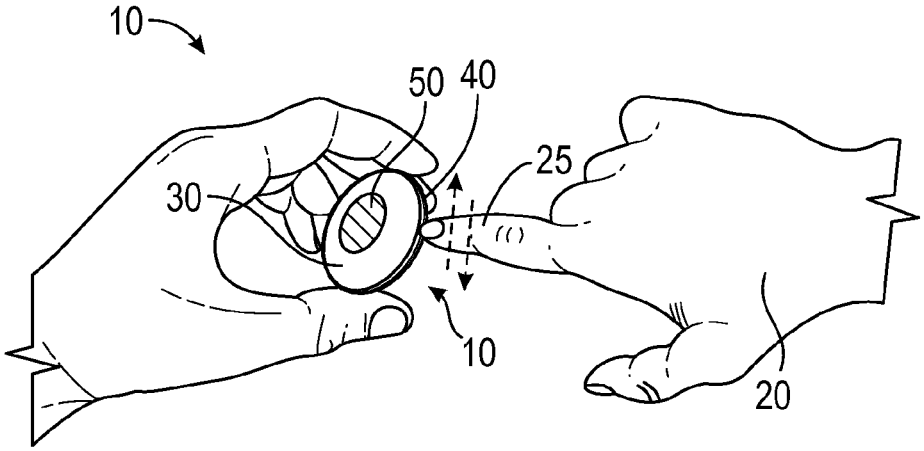
FIG. 1 is a perspective view of the invention, illustrated as used by a person for filing a fingernail.
Figure 2:
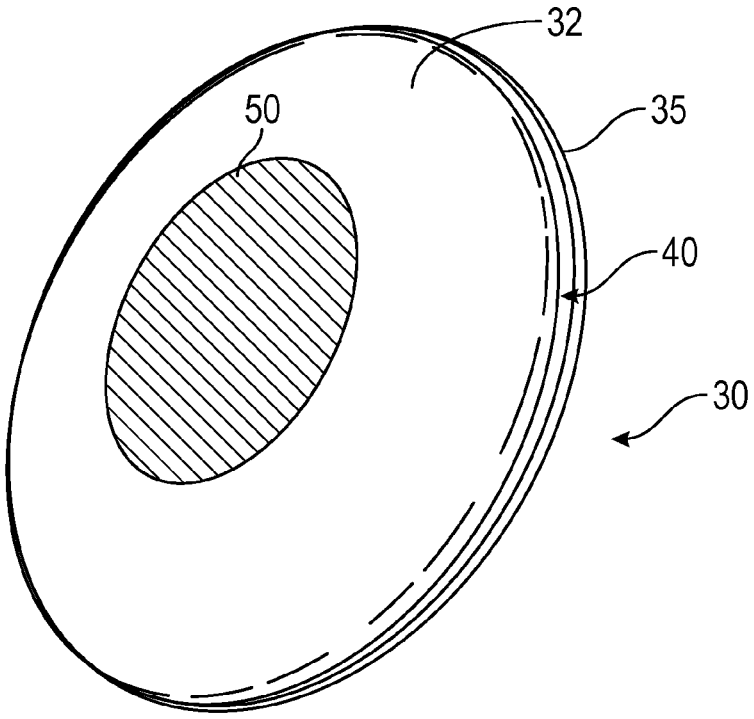
FIG. 2 is an enlarged perspective view of the invention.
Figure 3:
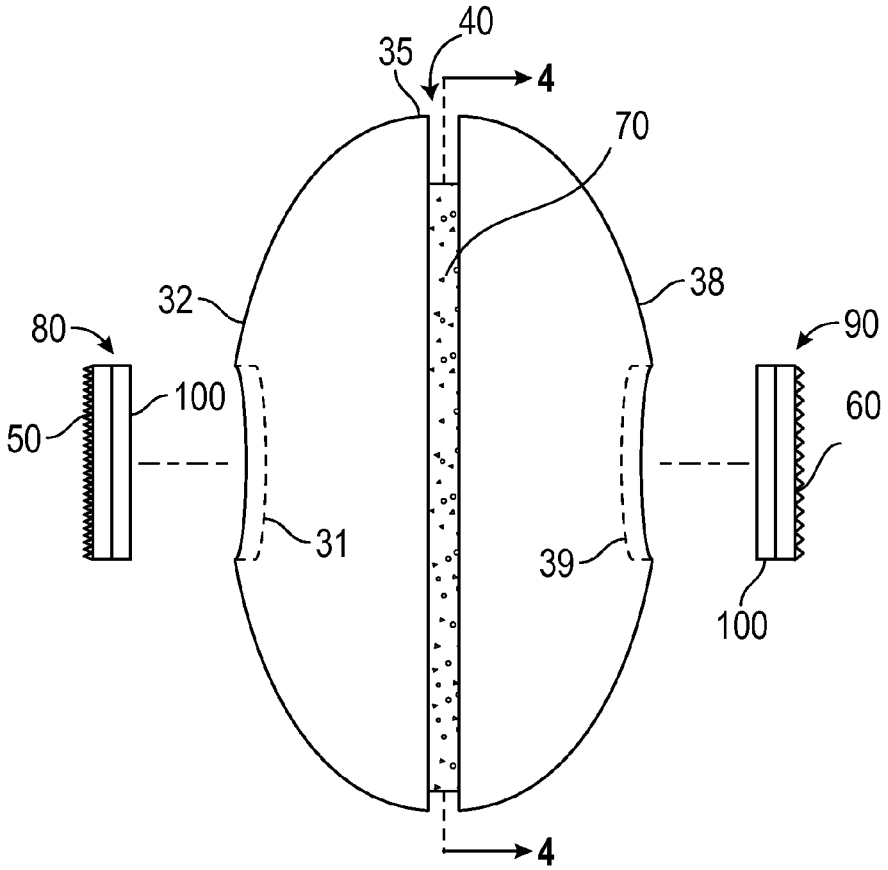
FIG. 3 is an exploded side elevational view of the invention, illustrating a first and second abrading surface as exploded away from a body of the invention.
Figure 4A:
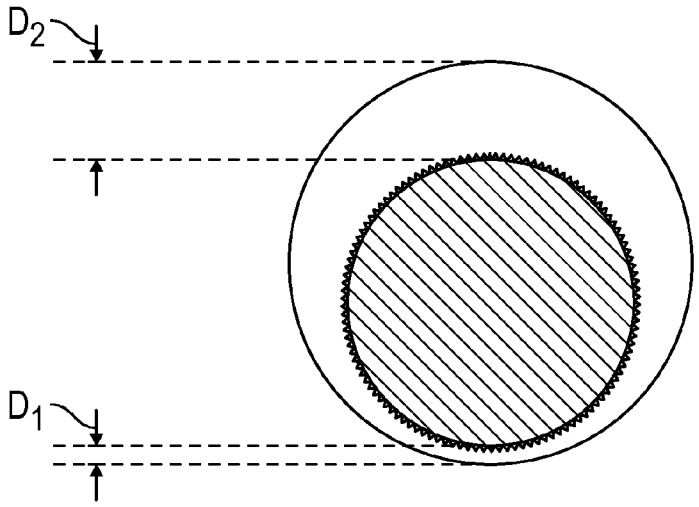
FIG. 4A is a cross-sectional view of the invention, taken along lines 4-4 of FIG. 3, and illustrating a body having an oval shape in cross-section.
Figure 4B:
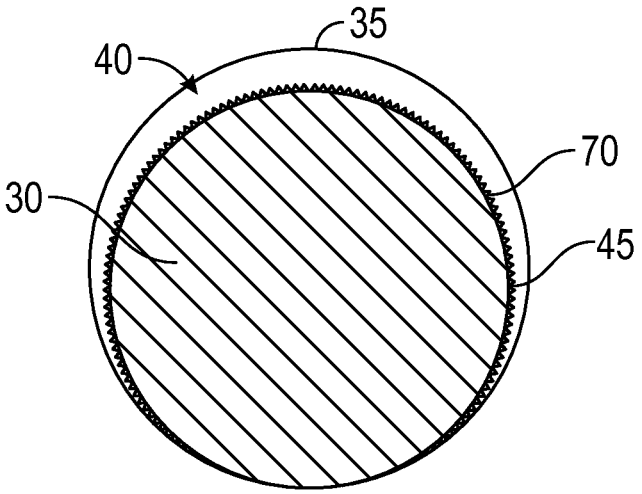
FIG. 4B is a cross-sectional view of the invention, taken along lines 4-4 of FIG. 3, but illustrating a body having a circular shape in cross-section.

FIGS. 1 and 2 illustrate an implement 10 for abrading or filing a nail 25 of a person 20, such as a fingernail 25 or a toenail 25. A body 30 has a first side 32, a second side 38, and a peripheral edge 35. The peripheral edge 35 has a peripheral groove 40 formed therearound. The groove 40 has a floor 45 that continuously or smoothly varies in depth based on a radial position. A perimeter abrading surface 70 is applied to the floor 45 of the groove 40 (FIGS. 3, 4A & 4B).

In use, the person 20 abrades a nail 25 by inserting the nail 25 into the groove 40 at the desired radial location and, moving the implement back and forth (FIG. 1), the nail is abraded to a length associated with the radial position.

Figure 5:
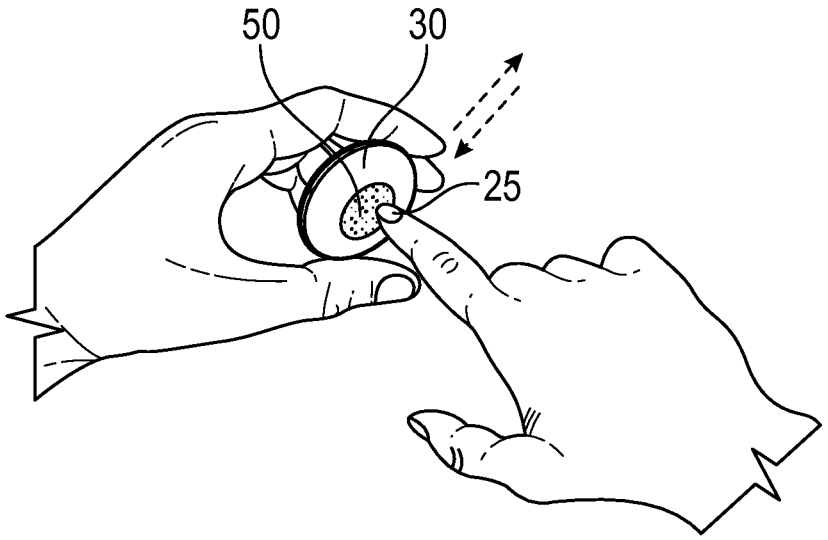
FIG. 5 is a perspective view of the invention, illustrated as used by a person for filing a fingernail with one of the abrading surfaces.

A first abrading surface 50 is applied to the first side 32 of the body 30, preferably via a removable disk 80 that adheres with an adhesive 100 to the first side 32 of the body 30. The person 20 may abrade a top or edge portion of the nail 25 by moving the nail 25 back and forth relative to the implement 10 across the first abrading surface 50 (FIG. 5). Adhesive 100 is preferably a pressure sensitive adhesive.

A second abrading surface 60, preferably via a second removable disk 90 that adheres with the adhesive 100 to the second side 38 of the body 30, is preferably applied to the second side 38 of the body 30. Both the first side 32 and second side 38 of the body 30 preferably include a first recessed area 31, and a second recessed area 39, for receiving the first and second removable disks 80, 90, respectively.

The second abrading surface 60 preferably has a different abrasiveness or grit than the first abrading surface 50, and each abrading surface 50, 60 preferably has a different abrasiveness than the perimeter abrading surface 70. For example, the perimeter abrading surface 70 may be a course and sharp abrading surface for abrading or filing length off of the nail 25. The first abrading surface 50 may be a pre-finishing abrasiveness, and the second abrading surface 60 may be used to do a final finish or polish on the nail 25 with a very fine grit or abrasive surface. The abrasive grit material used may include garnet, cerium oxide, flint, emery, corundum, aluminum oxide, diamond, or the like.

The body 30 is preferably oval (FIG. 4A) or circular (FIG. 4B) in plan view, but may take other shapes such as hexagonal (not shown) as desired. The body 30, peripheral groove 40, and perimeter abrading surface 70 may be formed through a machine milling process on an aluminum blank, or the like. Alternately, the body 30 may be molded with a rigid plastic material as two parts (not shown) that are adhered together, ultrasonically welded, or fit together through a frictional mechanical snap (not shown) formed into each part. In such an embodiment, the perimeter abrading surface 70 is adhered around the floor 45 of the peripheral groove 40. The first side 32 and/or the second side 38 may include indicia (not shown) indicating the depth of the peripheral groove 40 at discrete radial positions around the periphery of the body 30.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An implement for abrading a nail of a person, comprising:

a body having a first side, a second side, and a peripheral edge formed between an outer periphery of the first side and the second side, the peripheral edge having a peripheral groove formed therearound, the groove having a floor that continuously varies in depth based on a radial position;

a first abrading surface applied to the first side of the body; and a perimeter abrading surface applied to the floor of the groove;

whereby as the person abrades his nail by inserting the nail into the groove at a radial location corresponding to a desired nail length and moving the implement back and forth, the nail is abraded to the length associated with the radial position, and whereby the first abrading surface is useful to further abrade the nail.

2. The implement of claim 1 further including a second abrading surface applied to the second side of the body.

3. The implement of claim 2 wherein the first and second abrading surface have different abrasiveness.

4. The implement of claim 2 wherein the second abrading surface is included on a second removable disk which adheres with an adhesive to the second side of the body.

5. The implement of claim 4 wherein the second side of the body includes a second recessed area for receiving the second removable disk.

6. The implement of claim 1 wherein the first abrading surface is included on a first removable disk which adheres with an adhesive to the first side of the body.

7. The implement of claim 6 wherein the first side of the body includes a first recessed area for receiving the first removable disk.

8. The implement of claim 1 wherein the body is oval in plan view.

9. The implement of claim 1 wherein the body is circular in plan view.

10. The implement of claim 1 wherein the body, peripheral groove, and perimeter abrading surface are all formed through a machine milling process.

11. The implement of claim 1 wherein the perimeter abrading surface is adhered to the perimeter groove.

12. The implement of claim 1, wherein the first side and the second side are solid members preventing communication therethrough.

13. The implement of claim 1 wherein the first side of the body includes a first recessed area for receiving a first removable disk containing the first abrading surface.

14. A method of abrading a nail of a person, comprising the steps:

a) providing a body having a first side, a second side, and a peripheral edge formed between an outer periphery of the first side and the second side, the peripheral edge having a peripheral groove formed therearound, the groove having a floor that continuously varies in depth based on a radial position; a first abrading surface applied to the first side of the body; and a perimeter abrading surface applied to the floor of the groove;

b) selecting a radial position corresponding to a desired nail length;

c) inserting the nail at the radial position and moving the implement back and forth to abrade the nail.

15. The method of claim 14 further including the step d) abrading the nail with the first abrading surface.

16. An implement for abrading a nail of a person, comprising:

a body having a first solid side member, a second solid side member, and a peripheral edge formed between an outer periphery of the first side member and the second side member, the peripheral edge having a peripheral groove formed therearound, the groove having a floor that continuously varies in depth based on a radial position, wherein the depth is measured from the floor to the outer periphery of the first side member or the second side member;

a first abrading surface applied to the first side of the body; and a perimeter abrading surface applied to the floor of the groove;

whereby as the person abrades his nail by inserting the nail into the groove at a radial location corresponding to a desired nail length and moving the implement back and forth, the nail is abraded to the length associated with the radial position, and whereby the first abrading surface is useful to further abrade the nail.

17. The implement of claim 16 further including a second abrading surface applied to the second side of the body.

18. The implement of claim 17 wherein the first and second abrading surface have different abrasiveness.

* * * * *